US006753650B2

(12) United States Patent
Leichtfried et al.

(10) Patent No.: US 6,753,650 B2
(45) Date of Patent: Jun. 22, 2004

(54) METHOD FOR PRODUCING AN ELECTRIC LAMP AND FOIL CONFIGURATION

(75) Inventors: Gerhard Leichtfried, Reutte (AT); Bernhard Retter, Wängle (AT); Manfred Sulik, Reutte (AT)

(73) Assignee: Plansee Aktiengesellschaft, Reutte (AT)

( * ) Notice: Subject to any disclaimer, the term of this patent is extended or adjusted under 35 U.S.C. 154(b) by 300 days.

(21) Appl. No.: 09/861,421

(22) Filed: May 18, 2001

(65) Prior Publication Data

US 2002/0008477 A1 Jan. 24, 2002

(30) Foreign Application Priority Data

May 18, 2000 (AT) ..... GM 363/2000

(51) Int. Cl.[7] ..... H01J 17/18; H01J 61/36; H01J 9/32

(52) U.S. Cl. ..... 313/623; 445/27; 445/43

(58) Field of Search ..... 445/27, 43; 313/623, 313/332

(56) References Cited

U.S. PATENT DOCUMENTS

| | | | | |
|---|---|---|---|---|
| 3,420,944 A | | 1/1969 | Holcomb | |
| RE31,519 E | * | 2/1984 | Sobieski | 313/332 |
| 5,021,711 A | * | 6/1991 | Madden et al. | 313/623 |
| 5,578,892 A | * | 11/1996 | Whitman et al. | 313/112 |
| 5,962,976 A | | 10/1999 | Irisawa et al. | |
| 6,265,817 B1 | * | 7/2001 | Steinmann et al. | 313/332 |
| 6,354,900 B1 | | 3/2002 | Ohshima et al. | |

FOREIGN PATENT DOCUMENTS

| | | |
|---|---|---|
| AT | 386 612 B | 9/1988 |
| DE | 2 058 213 | 6/1971 |
| DE | 21 52 349 B2 | 5/1972 |
| DE | 29 47 230 C2 | 6/1980 |
| DE | 30 06 846 C2 | 9/1980 |
| DE | 196 03 300 A1 | 7/1997 |
| DE | 198 37 904 A1 | 4/1999 |
| DE | 199 28 996 A1 | 12/1999 |
| EP | 0 275 580 A1 | 7/1988 |
| EP | 0 309 749 B1 | 2/1993 |
| EP | 0573 114 A1 | 12/1993 |
| EP | 0 691 673 A2 | 1/1996 |
| EP | 0 551 939 B1 | 4/1998 |
| EP | 0 871 202 A2 | 10/1998 |
| GB | 780614 | 8/1957 |
| JP | 59-064548 | 4/1984 |

* cited by examiner

*Primary Examiner*—Kenneth J. Ramsey
(74) *Attorney, Agent, or Firm*—Laurence A. Greenberg; Werner H. Stemer; Ralph E. Locher

(57) ABSTRACT

A method for producing an electric lamp having a vitreous lamp bulb and a foil of molybdenum or a doped molybdenum alloy which is pinched in the lamp bulb includes post-treating the unfinished foil such that substantially non-contiguous, insular regions of material agglomerates are formed. The material agglomerates are formed of molybdenum, molybdenum alloys, titanium, silicon, an oxide, a mixed oxide and/or an oxidic compound, with a vapor pressure of in each case less than 10 mbar at 2000° C. The substantially non-contiguous, insular regions are formed on at least 5 percent and at most 60 percent of the area of the foil surface. In this way, the adhesive strength between the foil and the glass and therefore also the service life of the lamp are significantly improved.

9 Claims, No Drawings

METHOD FOR PRODUCING AN ELECTRIC LAMP AND FOIL CONFIGURATION

BACKGROUND OF THE INVENTION

FIELD OF THE INVENTION

The invention relates to a method for producing an electric lamp having a lamp bulb made from $SiO_2$ or glass with a high $SiO_2$ content and a current lead which includes a foil of molybdenum or a doped molybdenum alloy. The foil is pinched in the lamp bulb. The invention also relates to a foil configuration for an electric lamp.

In electric lamps with a lamp bulb made from glass, the current required for operating the lamp has to be fed into the interior of the lamp bulb via special current leads. Particularly in the case of lamps with a lamp bulb made from silica glass or a glass with a high $SiO_2$ content, such as for example in the case of halogen incandescent lamps, metal halide lamps, high-pressure mercury vapor lamps or high-pressure xenon lamps, a current lead or supply conductor of this type includes an outer lead, which enters the glass. The current lead also includes a molybdenum foil which is pinched or fused in a vacuum-tight manner in the glass. The current lead further includes an inner lead (e.g. holding wire, filament, electrode).

In order to achieve a vacuum-tight pinching or fusing of the molybdenum foil in the glass despite the very different coefficients of thermal expansion in particular of silica glass or glass materials with a high $SiO_2$ content and molybdenum, the foil is configured to be very thin (typically 15 to 50 $\mu$m), with a high width to thickness ratio (typically >50), and has side edges which taper in the form of a cutting blade.

The outer and inner leads, which are significantly thicker than the foil, have to be welded onto this thin molybdenum foil. The inner lead is in many cases formed of tungsten. Particularly with leads made from tungsten, this entails very high welding temperatures, which may result in embrittlement and consequently a fracturing of the molybdenum foil. Cracks in the foil can also occur during the pinching or melting process. Such cracks may be caused by the relative movement between the glass and the foil or by a build-up of tensile stresses during the cooling process, at temperatures which are below the stress relaxation temperature of the glass.

In order to improve the mechanical strength of the molybdenum foil, doped molybdenum alloys have been used instead of pure molybdenum.

German Patent No. DE-C-29 47 230 describes a molybdenum foil in which 0.25 to 1% of yttrium oxide particles are dispersed. This has the advantage that this foil has an improved welding performance and becomes less brittle when heat is introduced during welding. An important reason for the upper 1% limit is the realization that foils with higher dispersoid contents can only be deformed to a limited extent, and the result is an excessively high foil strength, which has an adverse effect on the relaxation of stresses in the lamp cap region during the cooling process when performing the pinching process and may lead to cracks in the quartz glass.

European Patent No. EP-B-0 275 580 describes a molybdenum alloy specifically for seal wires or fusion wires containing 0.01 to 2% by weight Of $Y_2O_3$ and 0.01 to 0.8% by weight of molybdenum boride, which compared to seal wires including a K—Si doped molybdenum alloy has improved recrystallization and production properties.

However, in addition to the mechanical properties of the molybdenum foil, it is also very important to improve the service life. The service life is determined by the oxidation resistance of the molybdenum foil and by the adhesive strength between the molybdenum foil and the silica glass or glass with a high $SiO_2$ content.

European Patent No. EP-B-0 691 673 describes a ribbon-like current lead based on molybdenum-yttrium oxide, which additionally contains 0.03 to 1% by weight of cerium oxide, with a cerium oxide to yttrium oxide ratio of 0.1 to 1. A foil with this composition has a significantly improved oxidation performance compared to a foil which is doped with yttrium oxide.

Together, all molybdenum materials which are doped with yttrium oxide have improved foil adhesion, which can be attributed, inter alia, to a surface reaction between $Y_2O_3$ and $SiO_2$ so as to form an yttrium silicate.

In accordance with German Patent No. DE-C-30 06 846, an improved oxidation resistance can also be achieved by providing a metallic covering for the molybdenum foil containing Ta, Nb, V, Cr, Zr, Ti, Y, La, Sc and Hf in which case, however, the bonding of the abovementioned metals to $SiO_2$ is very poor, so that these coverings, with the exception of Cr layers, have not been used in practice.

A particular form of oxidation-resistant layers including chromium, nickel, nickel-chromium alloys or molybdenum silicide is described in German Patent No. DE-B-21 52 349.

European Patent No. EP-B-0 309 749 describes a sealing-in or fusion between molybdenum and a vitreous material, with part of the molybdenum which is exposed to the oxidizing environment being covered with alkali metal silicate. However, this does not have a favorable effect on the bonding between the molybdenum and the glass. Molybdenum nitride layers in accordance with Published European Patent Application No. EP-A-0 573 114, phosphide layers in accordance with European Patent No. EP-B-0 551 939 or $SiO_2$ layers in accordance with Published German Patent Application No. DE-A-20 58 213 have also been disclosed for external protection against oxidation.

In accordance with U.S. Pat. No. 5,021,711, it has also been attempted to improve the resistance to oxidation by ion implantation. However, this process is highly complex and does not improve the $Mo/SiO_2$ adhesion.

Published German Patent Application No. DE-A-196 03 300 describes a molybdenum foil which is doped with 0.01 to 1% by weight of alkali-rich and alkaline earth-rich silicates and/or aluminates and/or borates of one or more elements selected from groups IIIb and/or IVb of the periodic system. This doping prevents the formation of cracks in the pinch seal, caused by the high mechanical stresses in the molybdenum/quartz glass composite. However, this does not improve foil adhesion compared to foils which are doped with $Y_2O_3$ mixed oxide or Y mixed oxide.

Moreover, it has also been attempted to improve the $SiO_2$/Mo adhesion by roughening the foil for example by sand blasting, as described in Published European Patent Application No. EP-A-0 871 202. However, this process is highly complex and leads to internal stresses being introduced in the molybdenum foil.

Overall, it can be stated that molybdenum foils which are doped with $Y_2O_3$ or Y mixed oxide are the most widespread material used for pinched-in current leads in the lamp industry. However, in the case of lamps which are exposed to very high thermal loads, such as for example in very compact metal halide lamps, the $Mo/SiO_2$ adhesion is often insufficient for these current leads.

SUMMARY OF THE INVENTION

It is accordingly an object of the invention to provide a method for producing an electric lamp having a vitreous lamp bulb and a pinched current lead including a foil of molybdenum or a doped molybdenum alloy which overcomes the above-mentioned disadvantages of the heretofore-known methods of this general type. Another object of the invention is to provide a foil configuration which overcomes the above-mentioned disadvantages of the heretofore-known foils of this general type and which results in an improved service life of an electric lamp.

With the foregoing and other objects in view there is provided, in accordance with the invention, a method for producing an electric lamp, the method includes the steps of:

providing an unfinished foil produced by a sintering process and a forming process, the unfinished foil being formed of a material selected from the group consisting of molybdenum and a doped molybdenum alloy, and the unfinished foil having a given surface structure and a given material composition;

post-treating the unfinished foil for producing a finished foil having substantially non-contiguous, insular regions of material agglomerates with at least one of a surface structure different from the given surface structure of the unfinished foil and a material composition different from the given material composition of the unfinished foil;

providing the substantially non-contiguous, insular regions of material agglomerates in 5 to 60% of a surface area of the finished foil;

forming the material agglomerates from at least one material selected from the group consisting of molybdenum, a molybdenum alloy, titanium, silicon, an oxide, a mixed oxide, and an oxidic compound with a vapor pressure of in each case less than 10 mbar at 2000° C.; and pinching the finished foil in a lamp bulb formed of a material selected from the group consisting of $SiO_2$ and an $SiO_2$-containing glass for providing a current lead.

In other words, according to the invention a process is provided for producing an electric lamp having a lamp bulb made from $SiO_2$ or glass with a high $SiO_2$ content and a current lead, which includes a foil of molybdenum or a doped molybdenum alloy which is pinched in the lamp bulb, wherein an unfinished foil, which has been produced using conventional sintering and forming processes, before being pinched in the glass bulb, is post-treated in such a manner that substantially non-contiguous, insular regions of material agglomerates with a surface structure and/or material composition which differs from that of the unfinished foil, formed of molybdenum or of its alloys, of titanium, of silicon, or of an oxide, a mixed oxide and/or an oxidic compound, with a vapor pressure of in each case less than 10 mbar at 2000° C., are formed on 5 to 60 percent of the area of the foil surface.

This ensures that, during the pinching or fusing operation, there is a large surface area available, so that the adhesive strength between the foil and the glass and therefore the long-term service life of the lamp are significantly improved. The foil adhesion is, which is a completely unexpected result, also improved if the material agglomerates which are present on the foil prior to the fusing operation are completely or partially dissolved in the silica glass or glass with a high $SiO_2$ content during the pinching or fusing operation.

Suitable materials for the material agglomerates are oxides, such as $Al_2O_3$, $ZrO_2$, $Y_2O_3$, $TiO_2$, silicates, aluminates, and also Mo, Ti, Si or their alloys.

It has proven particularly advantageous to use a foil of which at least 5 percent by area to at most 20 percent by area of the surface includes non-contiguous material agglomerates.

The mean size of the individual material agglomerates is advantageously less than 5 $\mu$m.

In a further particularly advantageous embodiment of the invention, it has proven expedient if a foil is used whose material agglomerates are formed of titanium oxide or a titanium mixed oxide.

According to another mode of the invention, the material agglomerates are formed of yttrium oxide or an yttrium mixed oxide.

In order to form the non-contiguous material agglomerates, it is advantageous to apply a slip or to use a vapor deposition, followed by an annealing treatment at a temperature of between 500° C. and 1400° C. This is a simple way of applying material agglomerates with an adhesive strength which is sufficient for further processing.

With the objects of the invention in view there is also provided, a foil configuration, including:

a foil formed of a material selected from the group consisting of molybdenum and a doped molybdenum alloy;

the foil having a given surface area with a first region and with second regions;

the first region having a first surface structure and a first material composition;

the second regions having at least one of a second surface structure different from the first surface structure and a second material composition different from the first material composition;

the second regions being substantially non-contiguous, insular regions covering 5 to 60% of the given surface area;

material agglomerates formed of at least one material selected from the group consisting of molybdenum, a molybdenum alloy, titanium, silicon, an oxide, a mixed oxide, and an oxidic compound with a vapor pressure of in each case less than 10 mbar at 2000° C.; and the material agglomerates being disposed substantially only in the second regions.

The above-defined foil configuration is used for producing electric lamps having a lamp bulb made from $SiO_2$ or glass with a high $SiO_2$ content.

Other features which are considered as characteristic for the invention are set forth in the appended claims.

Although the invention is illustrated and described herein as embodied in a method of producing a lamp and a foil configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

In the following text, the invention is explained in more detail on the basis of production examples and by comparative measurements.

EXAMPLE 1

500 g of yttrium oxide powder with a purity of 99.5% with a mean grain size of the primary particles of 230 nm were dispersed in 50 g of nitrocellulose and 750 ml of an alcohol-based solvent. The slip produced in this way was applied to an etched molybdenum foil of dimensions 2.5 mm×0.025 mm through the use of a dipping technique. This foil was then annealed or baked in a continuous process in dry hydrogen at a temperature of 1200° C. The surface proportion or coverage of $Y_2O_3$ was 12%, with a mean $Y_2O_3$ agglomerate size of 1.5 μm.

EXAMPLE 2

A slip including 350 g of titanium silicate powder with a purity of 99.7% with a mean grain size of the primary particles of 630 nm, 50 g of nitrocellulose and 750 ml of an alcohol-based solvent was prepared as described in example 1 and was applied to an etched Mo—Y mixed oxide foil with the dimensions 2.5 mm×0.025 mm ($Y_2O_3$ content: 0.48% by weight, $Ce_2O_3$ content: 0.07% by weight).

This foil was then annealed in a continuous process in dry hydrogen at a temperature of 1200° C. The foil surface was characterized by SEM (scanning electron microscope)/image analysis, the surface proportion of titanium silicate particles being 17%, with a mean titanium silicate agglomerate size of 1.1 μm.

EXAMPLE 3

A slip including 400 g of yttrium silicate powder with a purity of 99.2% with a mean grain size of the primary particles of 840 nm, 50 g of nitrocellulose and 750 ml of an alcohol-based solvent was prepared as described in example 1 and was applied to an etched Mo—Y mixed oxide foil with the dimensions 2.5 mm×0.025 mm ($Y_2O_3$ content: 0.48% by weight, $Ce_2O_3$ content: 0.07% by weight). This foil was then annealed in a continuous process in dry hydrogen at a temperature of 1200° C. The surface proportion of the yttrium silicate particles was 29%, with a mean yttrium silicate agglomerate size of 3.2 μm.

EXAMPLE 4

A slip including 250 g of silicon powder with a purity of 99.9% with a mean grain size of the primary particles of 210 nm, 50 g of nitrocellulose and 750 ml of alcohol-based solvent was prepared as described in example 1 and was applied to an etched Mo—Y mixed oxide foil of the dimensions 2.5 mm×0.025 mm ($Y_2O_3$ content: 0.48% by weight, $Ce_2O_3$ content: 0.07% by weight). This foil was then annealed in a continuous process in dry hydrogen at a temperature of 950° C. The surface proportion of the $Si/MoSi_2$ particles was 13%, with a mean $Si/MoSi_2$ agglomerate size of 2.3 μm.

EXAMPLE 5

A slip including 1000 g of molybdenum powder with a purity of 99.98% with a mean grain size of the primary particles of 1.5 μm, 50 g of nitrocellulose and 750 ml of an alcohol-based solvent was prepared as described in example 1 and was applied to an Mo—Y foil ($Y_2O_3$ content: 0.48% by weight, $Ce_2O_3$ content: 0.07% by weight) with the dimensions 2.5 mm×0.025 mm, the side edges of which had been shaped into the form of a cutting edge by mechanical deformation (edge angle 25°). This foil was then annealed in a continuous process in dry hydrogen at a temperature of 1400° C. The surface proportion of the Mo particles was approximately 50%, with a mean Mo agglomerate size of 2.9 μm.

In each case 20 so-called MR 16 halogen lamps were manufactured with the foils according to the invention in accordance with examples 1 to 5. For comparative purposes, standard etched Mo—Y mixed oxide foils as used for the production of the coated foils in accordance with examples 2 to 4 were also used in the uncoated state to produce 20 MR 16 halogen lamps. In each case 10 lamps were operated under standard operating conditions with a cap (base) temperature of 400° C., and the remaining 10 lamps were operated under harsher operating conditions with a cap temperature of 450° C., until failure. The service lives achieved are shown in the table below.

It can be seen clearly from the table that the lamps according to the invention with the coated molybdenum foils have a service life which is increased by up to 35% compared to the lamps according to the prior art with the uncoated molybdenum foils.

TABLE

| Foil | Service life* at 400° C. cap temperature [h] | Service life* at 450° C. cap temperature [h] |
|---|---|---|
| Mo- 0.48% by weight $Y_2O_3$ 0.07% by weight $Ce_2O_3$ | 760 | 380 |
| According to example 1 | 980 | 510 |
| According to example 2 | 990 | 500 |
| According to example 3 | 1010 | 490 |
| According to example 4 | 820 | 450 |
| According to example 5 | 790 | 440 |

*Mean of 10 measurements

We claim:

1. A method for producing an electric lamp, the method which comprises:

providing an unfinished foil produced by a sintering process and a forming process, the unfinished foil being formed of a material selected from the group consisting of molybdenum and a doped molybdenum alloy, and the unfinished foil having a given surface structure and a given material composition;

post-treating the unfinished foil for producing a finished foil having substantially non-contiguous, insular regions of material agglomerates with at least one of a surface structure different from the given surface structure of the unfinished foil and a material composition different from the given material composition of the unfinished foil;

providing the substantially non-contiguous, insular regions of material agglomerates in 5 to 60% of a surface area of the finished foil;

forming the material agglomerates from at least one material selected from the group consisting of molybdenum, a molybdenum alloy, titanium, silicon, an oxide, a mixed oxide, and an oxidic compound with a vapor pressure of in each case less than 10 mbar at 2000° C.; and sealing the finished foil in a lamp bulb formed of a material selected from the group consisting of $SiO_2$ and an $SiO_2$-containing glass for providing a current lead.

2. The method for producing an electric lamp according to claim 1, which comprises providing the substantially non-contiguous, insular regions of material agglomerates in 5 to 20% of the surface area of the finished foil.

3. The method for producing an electric lamp according to claim 1, which comprises forming the material agglomerates such that a mean size of individual ones of the material agglomerates is less than 5 μm.

4. The method for producing an electric lamp according to claim 1, which comprises forming the material agglomerates from yttrium oxide.

5. The method for producing an electric lamp according to claim 1, which comprises forming the material agglomerates from an yttrium mixed oxide.

6. The method for producing an electric lamp according to claim 1, which comprises providing the substantially non-contiguous, insular regions of material agglomerates by applying a slip on the unfinished foil and subsequently annealing the unfinished foil at a temperature of between 500° C. and 1400° C. for producing the finished foil.

7. The method for producing an electric lamp according to claim 1, which comprises providing the substantially non-contiguous, insular regions of material agglomerates by using a vapor deposition process and subsequently an annealing process at a temperature of between 500° C. and 1400° C.

8. A foil configuration, comprising:

a foil formed of a material selected from the group consisting of molybdenum and a doped molybdenum alloy;

said foil having opposed knife-edgeds and;

said foil having a given surface area with a first region and with second regions;

said first region having a first surface structure and a first material composition;

said second regions having at least one of a second surface structure different from said first surface structure and a second material composition different from said first material composition;

said second regions being substantially non-contiguous, insular regions covering 5 to 60% of said given surface area;

material agglomerates formed of at least one material selected from the group consisting of molybdenum, a molybdenum alloy, titanium, silicon, an oxide, a mixed oxide, and an oxidic compound with a vapor pressure of in each case less than 10 mbar at 2000° C.; and said material agglomerates being disposed substantially only in said second regions.

9. A method of producing a foil configuration, the method which comprises:

providing an unfinished foil produced by a sintering process and a forming process, the unfinished foil being formed of a material selected from the group consisting of molybdenun and a doped molybdenum alloy, and the unfinished foil having a given surface structure and a given material composition;

post-treating the unfinished foil for producing a finished foil having substantially non-contiguous insular regions of material agglomerates with at least one of a surface structure different from the given surface structure of the unfinished foil and a material composition different from the given material composition of the unfinished toil;

providing the substantially non-contiguous, insular regions of material agglomerates in 5 to 60% of a surface area of the finished foil; and forming the material agglomerates from at least one material selected from the group consisting of molybdenum, a molybdenum alloy, titanium, silicon, an oxide, a mixed oxide, and an oxidic compound with a vapor pressure of in each case less than 10 mbar at 2000° C.

* * * * *